US008932089B2

(12) United States Patent
Grünwald

(10) Patent No.: US 8,932,089 B2
(45) Date of Patent: Jan. 13, 2015

(54) CONNECTING ARRANGEMENT HAVING A TERMINAL SCREW WITH A BLIND HOLE COVERING A THROUGH-HOLE AND A FIXING SCREW

(71) Applicant: Jan Grünwald, Hennigsdorf (DE)

(72) Inventor: Jan Grünwald, Hennigsdorf (DE)

(73) Assignee: Siemens Aktiengesellschaft, Munich (DE)

( * ) Notice: Subject to any disclaimer, the term of this patent is extended or adjusted under 35 U.S.C. 154(b) by 16 days.

(21) Appl. No.: 13/748,755

(22) Filed: Jan. 24, 2013

(65) Prior Publication Data

US 2013/0203302 A1 Aug. 8, 2013

(30) Foreign Application Priority Data

Feb. 2, 2012 (DE) ..... 10 2012 201 555

(51) Int. Cl.
*H01R 4/36* (2006.01)
*H01R 9/18* (2006.01)

(52) U.S. Cl.
CPC ... *H01R 4/36* (2013.01); *H01R 9/18* (2013.01)
USPC ..... 439/814

(58) Field of Classification Search
USPC ..... 439/801, 810, 814, 353, 727, 793
See application file for complete search history.

(56) References Cited

U.S. PATENT DOCUMENTS

| | | | | |
|---|---|---|---|---|
| 6,079,923 | A * | 6/2000 | Ross et al. | 411/353 |
| 7,946,895 | B2 * | 5/2011 | Hain et al. | 439/793 |
| 8,162,702 | B2 * | 4/2012 | Opper et al. | 439/801 |
| 2006/0049145 | A1 | 3/2006 | Shea et al. | |
| 2009/0137160 | A1 * | 5/2009 | Opper et al. | 439/727 |
| 2011/0065335 | A1 * | 3/2011 | Hain et al. | 439/810 |
| 2011/0226594 | A1 | 9/2011 | Raabe | |
| 2012/0204406 | A1 * | 8/2012 | Opper et al. | 29/428 |

OTHER PUBLICATIONS

German Priority Document German Application 102012201555.8.

* cited by examiner

*Primary Examiner* — Chandrika Prasad
(74) *Attorney, Agent, or Firm* — Harness, Dickey & Pierce, P.L.C.

(57) ABSTRACT

A connecting arrangement is disclosed for an electrical switching device for attaching an electrical connection to the electrical switching device, including a terminal, a fixing screw and a terminal screw including an external thread. The terminal includes a connection opening for introducing the electrical connection, a fixing opening through which the fixing screw can be passed for the purpose of securing the terminal to an electrical contact of the electrical switching device, and a terminal bore having an internal thread through which the terminal screw can be screwed in for the purpose of retaining the electrical connection. The terminal screw includes a through-hole and, arranged concentrically with respect to the through-hole, a blind hole which is embodied for receiving a turning tool. The blind hole covers the through-hole and has a greater cross-sectional area than the through-hole. An electrical switching device including at least one such connecting arrangement is disclosed.

17 Claims, 2 Drawing Sheets

CONNECTING ARRANGEMENT HAVING A TERMINAL SCREW WITH A BLIND HOLE COVERING A THROUGH-HOLE AND A FIXING SCREW

PRIORITY STATEMENT

The present application hereby claims priority under 35 U.S.C. §119 to German patent application number DE 10 2012 201 555.8 filed Feb. 2, 2012, the entire contents of which are hereby incorporated herein by reference.

FIELD

At least one embodiment of the invention generally relates to a connecting arrangement for an electrical switching device, in particular a low-voltage circuit breaker, for attaching an electrical connection to the electrical switching device. The connecting arrangement has a terminal, a fixing screw and a terminal screw having an external thread. The terminal has a connection opening for introducing the electrical connection, a fixing opening through which the fixing screw can be passed in order to secure the terminal in a releasable manner to an electrical contact of the electrical switching device, and a terminal bore having an internal thread through which the terminal screw can be screwed in for the purpose of retaining the electrical connection. The invention further relates to an electrical switching device having at least one connecting arrangement for attaching an electrical connection to the electrical switching device.

BACKGROUND

The function of electrical switching devices, such as low-voltage circuit breakers, is to decouple one or more electricity-consuming loads from a voltage supply network when a specific malfunction occurs. The archetypal malfunction is the occurrence of a short-circuit current, and the circuit breakers are conventionally designed to move a switching element in the event of such a short-circuit current and thereby decouple the connection between loads and voltage supply network.

For decades electrical loads in the industrial domain have been protected against overcurrents and short-circuits by means of low-voltage or compact molded-case circuit breakers (MCCBs) which interrupt the electrical circuit in the fault situations described.

Electrical switching devices or low-voltage circuit breakers are available in very different design formats. These differ essentially in terms of their current-carrying capacities and consequently considerably in terms of their size.

Electrical switching devices such as low-voltage circuit breakers have one or more connecting arrangements comprising a terminal having in each case a connection opening in order to attach electrical connections, such as cables, busbars or cable shoes, to the electrical switching device. However, there are also terminals to which two or six cables, for example, can be connected. For example, a user in the field of low-voltage circuit breakers can install different terminal variants which allow, for example, bare cables, perforated or unperforated copper busbars or even cable shoes to be connected directly.

For assembly, it is necessary to install a connecting arrangement, also referred to as connection accessories, in the switch housing. Typically, the terminal is first secured to an electrical contact of the electrical switching device before a terminal screw which is subsequently intended to retain the cable in the terminal is inserted into the terminal. This means either that there must be a sufficiently large connection opening or cable opening present in the terminal, that it must be possible to open the electrical switching device from the front side of the switching device, or that there must be sufficient space above between the terminal and the switching device housing to enable the terminal screw to be installed. If this is not possible, the terminal, including the terminal screw, cannot be installed in the low-voltage circuit breaker.

Another possibility for securing a terminal to an electrical switching device is to mount the terminal from the rear side of the switching device. In this case the terminal screw could already be in a screwed-in position in the terminal. With this approach, however, it would be necessary to disassemble the electrical switching device, in particular a low-voltage circuit breaker, every time the terminal attachment is checked.

It is problematic to install a connecting arrangement comprising a terminal, a fixing screw for securing the terminal to an electrical contact of the electrical switching device and a terminal screw for retaining an electrical connection, in particular a cable, in the connection opening, also referred to as the terminal opening, when there is only a small amount of installation space available. If the installation space is too small for a connecting arrangement of said type, recourse can be made to a different connecting arrangement or terminal variant which can be installed in a different way. Thus, rather than being screwed onto the electrical contact, the terminal can be clamped behind the electrical contact. However, a terminal which is positioned/clamped behind the electrical contact allows very small electrical connections, in particular cables, to deviate sharply to the left or right because of its large connection opening or cable opening. Furthermore, these terminals are bigger and heavier than a terminal which has a small cable opening and is designed especially for very small cables. The small cable opening now no longer allows the terminal screw to be installed through it and above between terminal and housing wall there is insufficient space for the installation, because the terminal must first be secured to the electrical contact.

SUMMARY

At least one embodiment of the present invention enables a connecting arrangement to be secured easily and quickly to an electrical contact of an electrical switching device, in particular a low-voltage circuit breaker, when only a small amount of installation space is available for accommodating a connecting arrangement in the electrical switching device.

A connecting arrangement is disclosed for an electrical switching device for attaching an electrical connection to the electrical switching device. Further features and details of the invention will emerge from the dependent claims, the description and the drawings. Features and details which are described therein in connection with the connecting arrangement obviously apply also in connection with the electrical switching device according to the invention, and vice versa in each case, such that reciprocal reference is made or can be made in all cases in respect of the disclosure relating to the individual inventive aspects.

According to a first aspect of at least one embodiment of the invention is directed to a connecting arrangement for an electrical switching device, in particular a low-voltage circuit breaker, for attaching an electrical connection to the electrical switching device. In this case the electrical switching device has a terminal, a fixing screw and a terminal screw having an external thread. The terminal has a connection opening for introducing the electrical connection, a fixing opening through which the fixing screw can be passed in order to secure the terminal in a releasable manner to an electrical contact of the electrical switching device, and a terminal bore having an internal thread through which the terminal screw can be screwed in for the purpose of retaining the electrical connection. The connecting arrangement is furthermore characterized in that the terminal screw has a through-hole and, arranged concentrically with respect to the through-hole, a blind hole which is embodied for receiving a turning tool, for example a screwdriver or a hexagon socket wrench, wherein the blind hole covers the through-hole and has a greater cross-sectional area than the through-hole.

BRIEF DESCRIPTION OF THE DRAWINGS

A connecting arrangement according to an embodiment of the invention and its advantages, as well as an electrical switching device according to an embodiment of the invention and its advantages, are explained in more detail below with reference to schematic drawings, in which.

Figure 1:
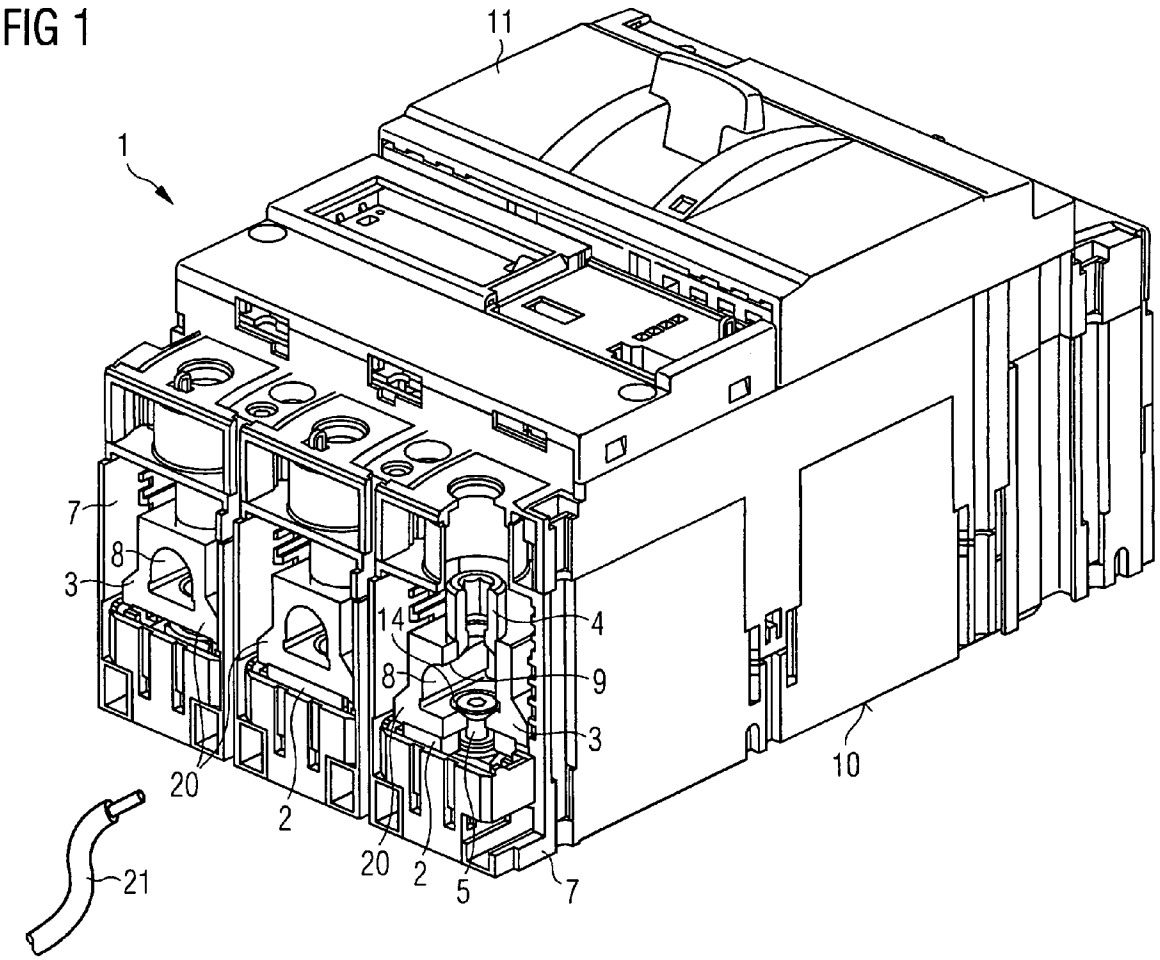
FIG. 1 shows in a perspective view an inventive terminal screw of a connecting arrangement of an electrical switching device.

Elements having the same function and mode of operation are labeled with the same reference signs in each of the two figures.

DETAILED DESCRIPTION OF THE EXAMPLE EMBODIMENTS

The present invention will be further described in detail in conjunction with the accompanying drawings and embodiments. It should be understood that the particular embodiments described herein are only used to illustrate the present invention but not to limit the present invention.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

According to a first aspect of at least one embodiment of the invention is directed to a connecting arrangement for an electrical switching device, in particular a low-voltage circuit breaker, for attaching an electrical connection to the electrical switching device. In this case the electrical switching device has a terminal, a fixing screw and a terminal screw having an external thread. The terminal has a connection opening for introducing the electrical connection, a fixing opening through which the fixing screw can be passed in order to secure the terminal in a releasable manner to an electrical contact of the electrical switching device, and a terminal bore having an internal thread through which the terminal screw can be screwed in for the purpose of retaining the electrical connection. The connecting arrangement is furthermore characterized in that the terminal screw has a through-hole and, arranged concentrically with respect to the through-hole, a blind hole which is embodied for receiving a turning tool, for example a screwdriver or a hexagon socket wrench, wherein the blind hole covers the through-hole and has a greater cross-sectional area than the through-hole.

A connecting arrangement of this type can be installed in electrical switching devices, in particular low-voltage circuit breakers, in which only a small amount of installation space is present for accommodating a terminal or a connecting arrangement. This is ensured in that the terminal screw has a through-hole and, arranged concentrically with respect to the through-hole, a blind hole which is embodied for receiving a turning tool. In this case the blind hole covers the through-hole. The blind hole also has a greater cross-sectional area than the through-hole, thereby ensuring that a turning tool introduced into the blind hole cannot be inserted so far as to enter the through-hole. Because the cross-sectional area of the through-hole is less than the cross-sectional area of the blind hole and the through-hole is arranged flush with the blind hole, a stop for a turning tool is formed at the junction between the blind hole and the through-hole. In this case the turning tool advantageously has the same shape in cross-section as the blind hole so that said tool can be introduced in a positive-fitting manner into the blind hole.

The blind hole covers the through-hole such that a fixing tool can be passed through the blind hole in order to secure the fixing screw which has been passed through a fixing opening in the terminal to an electrical contact of the electrical switching device.

By virtue of the special embodiment of the connecting arrangement, in particular that of the terminal screw, the latter can be screwed into the terminal before the terminal is introduced into the receptacle on the electrical switching device and the terminal can nonetheless be secured to an electrical contact of the electrical switching device by way of the fixing screw. This is made possible in that the fixing tool, for example a turning tool such as a screwdriver or a hexagon socket wrench, can be passed through the terminal screw in order to come into engagement with the fixing screw.

An installation technician assembling the connecting arrangement does not need to introduce a turning tool through the connection opening in order to turn the fixing screw. This is also scarcely possible in the case of electrical switching devices which provide a small receiving space for accommodating a terminal and, associated therewith, in the case of connecting arrangements which have a small terminal.

In particular a connecting arrangement of this type ensures the attachment of an electrical connection to the electrical switching device from the front side. In other words, it is made possible by way of the inventive connecting arrangement, in particular the special embodiment of the terminal screw of the connecting arrangement, to attach an electrical connection to the electrical switching device, having a small connection opening or cable opening, from the front, that is to say from the front side of the electrical switching device, in particular the front side of a low-voltage circuit breaker.

The through-hole preferably has the shape of a circular borehole. Such a shape of the through-hole ensures that a fixing tool can be turned in the through-hole in order to tighten the fixing screw of the connecting arrangement. The blind hole, which has a greater cross-sectional area compared to the through-hole, can have different cross-sections. According to a preferred development of an embodiment of the invention it can be provided in the case of a connecting arrangement that the blind hole have an angular, in particular a square or equilaterally hexagonal, cross-section. A corresponding turning tool, such as in particular a hexagon socket wrench or a square box wrench, can be introduced into such a blind hole as far as the beginning of the through-hole into the terminal screw in order to screw in or unscrew the latter in the terminal bore of the terminal. The terminal screw therefore has an external thread on its external lateral surface, while the terminal bore has an internal thread for receiving the terminal screw.

Preferably it can furthermore be provided in the case of a connecting arrangement that the fixing screw is a countersunk head screw and the fixing opening has a conically widened region for receiving a head of the fixing screw. The shaft of the fixing screw can be passed through the fixing opening in the terminal, the head of the fixing screw being in positive-fitting contact in the conically widened region of the fixing opening when the shaft of the fixing screw has been screwed into an electrical contact of the electrical switching device. The electrical contact of the electrical switching device can have a blind bore for receiving the shaft of the fixing screw.

Alternatively thereto, the electrical contact of the electrical switching device can have a through-hole and the fixing screw can be screwed into a nut behind the electrical contact. The fixing opening of the terminal is arranged coaxially or approximately coaxially with respect to the terminal bore of the terminal. This ensures that a fixing tool introduced through the terminal bore can screw the fixing screw securely into the electrical contact. The widened region of the fixing opening and the head of the countersunk head screw are coordinated with one another in such a way that the head of the countersunk head screw can be introduced completely into the widened region. As a result the fixing screw does not obstruct the introduction of an electrical connection, in particular a cable, into the connection opening or cable opening of the terminal.

The countersunk head screw can be embodied in a variety of ways. Thus, the countersunk head screw can be for example a countersunk head screw having a hexagon socket, a countersunk head screw having a slot, a countersunk head screw having a cross-recessed head, or a Torx countersunk head screw.

According to a further preferred development of an embodiment of the invention it can be provided in the case of the connecting arrangement that the through-hole has a circumferential first chamfer at the junction to the blind hole. In other words, a conical taper is advantageously provided from the blind hole to the through-hole so that a fixing tool introduced through the blind hole can be easily passed through the through-hole or threaded into the through-hole.

Preferably it can furthermore be provided in the case of a connecting arrangement that the blind hole has a circumferential second chamfer. The second chamfer is arranged on the side of the blind hole which serves to introduce the turning tool for turning the terminal screw. This enables the turning tool to be introduced easily and reliably into the blind hole of the terminal screw.

According to a further preferred development of an embodiment of the invention, it can be provided in the case of a connecting arrangement that on its external face the terminal screw has a circumferential third chamfer at one end or at both ends. A third chamfer is of advantage in particular on the side of the terminal screw which is introduced first into the terminal bore because this makes it easier to screw the terminal screw into the terminal bore. A circumferential third chamfer at both ends of the terminal screw enables the terminal screw to be screwed into the terminal bore from both sides.

Preferably the aforementioned chamfers have an angle of between 30° and 60°, in particular of 45°. This ensures that the terminal screw can be introduced with ease into the terminal bore and/or that the turning tools can be reliably introduced into the terminal screw and/or can be passed through the terminal screw.

The blind hole does not penetrate the terminal screw completely, so the turning tool required for turning the terminal screw cannot be passed through the same. To ensure the turning tool has a sufficiently good hold in the terminal screw, the blind hole advantageously extends over 50% to 90% of the length of the terminal screw.

According to a second aspect of an embodiment of the invention, an electrical switching device is disclosed comprising at least one connecting arrangement according to the first aspect of an embodiment of the invention, wherein a connecting arrangement is secured by means of its fixing screw in a releasable manner to at least one electrical contact of the electrical switching device. Preferably the electrical switching device is a low-voltage circuit breaker. With an electrical switching device of this type, in particular a low-voltage circuit breaker of this type, it is possible, in spite of little installation space being available for accommodating at least one connecting arrangement, to install said connecting arrangement easily on the electrical switching device or the low-voltage circuit breaker and remove it therefrom. It goes without saying that all of the advantages produced in the case of a connecting arrangement according to the first aspect of an embodiment of the invention apply also to an electrical switching device according to an embodiment of the invention or to a low-voltage circuit breaker according to an embodiment of the invention.

With an electrical switching device of this type, it is easily possible to check the secure attachment of the connecting arrangement or the terminal, because both the fixing screw and the terminal screw are easily accessible from the front side of the electrical switching device, in particular of the low-voltage circuit breaker. In other words, an electrical switching device of this type does not need to be removed from its installed position, for example from a top hat rail, in order to check a connecting arrangement. In particular an electrical switching device of this type, such as a thus embodied low-voltage circuit breaker, enables the installation of one or more very small connecting arrangements or of one or more very small terminals, each of which has a small connection opening or cable opening for attaching an electrical connection, because it is possible to secure the terminal of the connecting arrangements from the front side of the electrical switching device.

Figure 2:
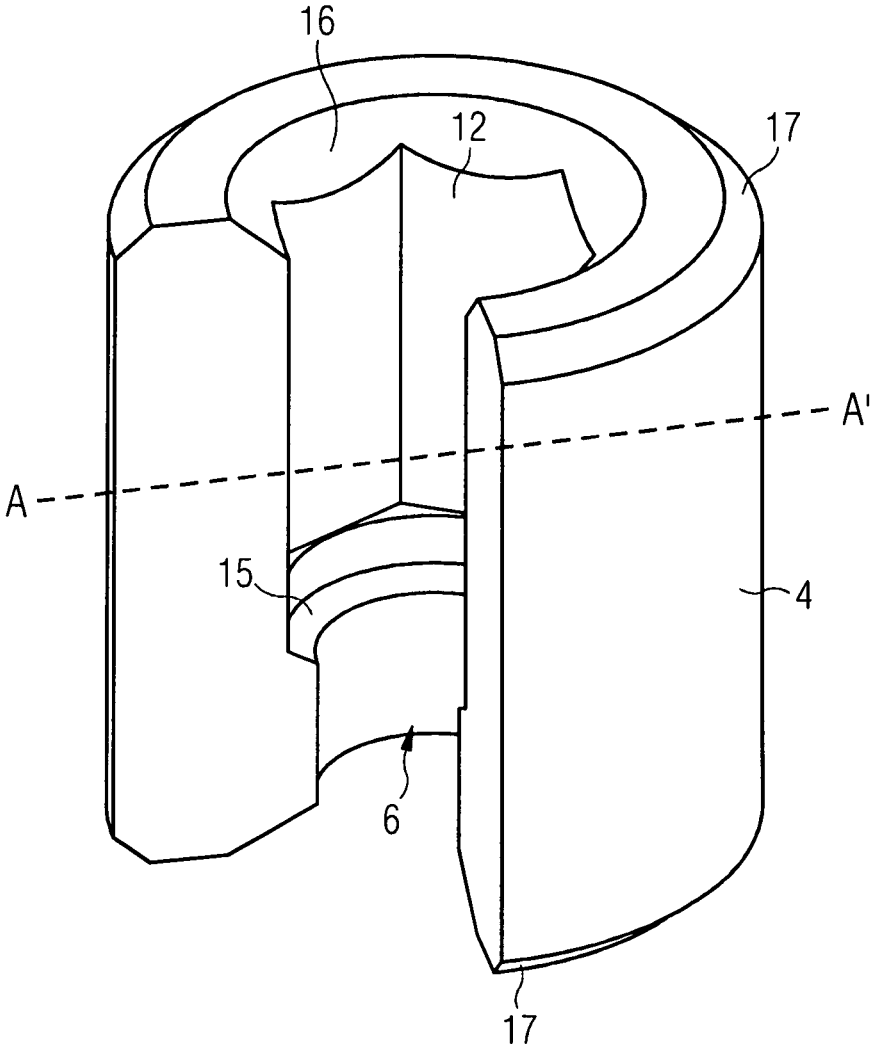
FIG. 2 shows in a perspective view an electrical switching device having three inventive connecting arrangements.

FIG. 1 shows an inventive terminal screw 4 of a connecting arrangement 20 of an electrical switching device 1, in particular a low-voltage circuit breaker as illustrated in FIG. 2, in a schematic perspective view.

A terminal screw 4 of this type can remain in the terminal 3 of a connecting arrangement 20 during the installation of the connecting arrangement 20, because the terminal 3 can be secured through the terminal screw 4 to an electrical contact 2 of an electrical switching device 1, such as a low-voltage circuit breaker, by way of a fixing screw 5.

The terminal screw 4 has a through-hole 6 which is smaller than the turning tool that is to be used for retaining an electrical connection such as a cable, smaller, for example, than a hexagon socket. The fixing screw 5 has an even smaller tool opening, for example for a hexagon socket, for securing the terminal 3 to the electrical contact 2.

A connecting arrangement 20 having a terminal screw 4 of this type can be very easily installed in an electrical switching device 1, in particular a low-voltage circuit breaker, even when there is only a small amount of installation space available for accommodating the connecting arrangement 20. This is ensured by way of the terminal screw 4, because the latter has a through-hole 6 and, arranged concentrically with respect to the through-hole 6, a blind hole 12 which is embodied for accommodating a turning tool. In this case the blind hole 12 covers the through-hole 6. The blind hole 12 may have a cross section of a desired shape. In FIG. 2, the cross-section may be taken along a dashed line A-A'In particular the blind hole 12 has a greater cross-sectional area than the through-hole 6. By this, it is ensured that a turning tool introduced into the blind hole 12 cannot be passed through the through-hole 6. Because the cross-sectional area of the through-hole 6 is smaller than the cross-sectional area of the blind hole 12 and the through-hole 6 is arranged flush with the blind hole 12, the circumferential first chamfer 15 at the junction between the blind hole 12 and the through-hole 6 forms a stop for a turning tool.

The terminal screw 4 does, however, allow a fixing tool to be passed through as far the fixing screw 5 of the terminal 3 in order to secure the latter to an electrical contact 2 of the electrical switching device 1; see FIG. 2. By virtue of the special embodiment of the terminal screw 4 the latter can be secured to the terminal 3 before the terminal 3 is introduced into the receptacle on the electrical switching device 1. This is made possible because a fixing tool, for example a turning tool such as a screwdriver, can be passed through the terminal screw 4 in order to come into engagement with the fixing screw 5.

Because the fixing screw 5 can be accessed from the front side 11 of the switching device it is possible to check the connecting arrangement 20, in particular the secure attachment of the terminal 3 of the connecting arrangement 20 to an electrical contact 2 of the electrical switching device 1. This saves time and costs in the checking of the terminal attachment. In particular there is no need to remove the electrical switching device 1 from its installed position, for example from a top hat rail, in order to check the fit of the connecting arrangement 20 on an electrical contact 2 of the electrical switching device 1.

The through-hole 6 of the terminal screw 4 has a circular cross-section. This enables a fixing tool for turning the fixing screw 5 of the connecting arrangement 20 to be turned easily in the through-hole 6. The blind hole 12 has an equilaterally hexagonal cross-section. A corresponding turning tool, such as a hexagon socket wrench, can be introduced into a blind hole 12 of this type as far as the beginning of the first chamfer 15, which serves as a stop for the turning tool, in order to screw in the terminal screw 4 in the terminal bore 9 of the terminal 3 or to unscrew the same. The terminal screw 4 has an external thread (not shown in further detail) on its external lateral surface. The terminal bore 9 in the terminal 3 has a corresponding internal thread for receiving the terminal screw 4.

The fixing screw 5 is a countersunk head screw and the fixing opening 14 has a conically widened region for receiving the head of the fixing screw 5. The shaft of the fixing screw 5 is passed through the fixing opening 14 in the terminal 3, the head of the fixing screw 5 being in positive-fitting contact in the conically widened region of the fixing opening 14. The fixing opening 14 of the terminal 3 is arranged coaxially with respect to the terminal bore 9 of the terminal 3. This ensures that the fixing tool introduced through the terminal bore 9 can screw the fixing screw 5 securely into the electrical contact 2 of the electrical switching device 1 or unscrew the same therefrom. The fixing opening 14 and the head of the countersunk head screw 5 of a connecting arrangement 20 complement one another in such a way that the head of the countersunk head screw 5 is introduced completely into the widened region of the fixing opening 14. As a result the countersunk head screw 5 does not obstruct the introduction of an electrical connection to an electrical connector 21. In particular, the electrical connector 21 may be a cable that is insertable into the connection opening 8 of the terminal 3.

The countersunk head screws 5 of the connecting arrangements 20 are embodied as countersunk head screws having a hexagon socket.

The circumferential first chamfer 15 enables a fixing tool introduced through the blind hole 12 to be passed easily through the through-hole 6 or threaded into the through-hole 6. The terminal screw 4 has a circumferential second chamfer 16 at the beginning of the blind hole 12. The second chamfer 16 serves to facilitate the introduction of a turning tool into the blind hole 12 of the terminal screw 4.

On its external face the terminal screw 4 additionally has a circumferential third chamfer 17 at each of its two ends. This has the advantage in particular of making it easier to screw the terminal screw 4 into the terminal bore 9 of the terminal 3. The chamfers 15, 16, 17 have an angle of 45° with respect to the axis of rotation of the terminal screw 4. This ensures on the one hand that the terminal screw 4 can be introduced easily into the terminal bore 9 of the terminal 3, and on the other hand that the turning tools can be positively introduced into the terminal screw 4 or passed through the terminal screw 4.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims.

Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program, tangible computer readable medium and tangible computer program product. For example, of the aforementioned methods may be embodied in the form of a system or device, including, but not limited to, any of the structure for performing the methodology illustrated in the drawings.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

LIST OF REFERENCE SIGNS

1 Electrical switching device
2 Electrical contact
3 Terminal
4 Terminal screw
5 Fixing screw
6 Through-hole
7 Housing element
8 Connection opening
9 Terminal bore
10 Switching device rear side
11 Switching device front side
12 Blind hole
14 Fixing opening
15 Circumferential first chamfer
16 Circumferential second chamfer
17 Circumferential third chamfer
20 Connecting arrangement

What is claimed is:

1. A connecting arrangement for an electrical switching device for attaching an electrical connector to the electrical switching device, comprising:

a terminal;

a fixing screw; and a terminal screw including an external thread, the terminal including, a connection opening adapted to receive the electrical connector, a fixing opening through which the fixing screw is passable to secure the terminal in a releasable manner to an electrical contact of the electrical switching device, and a terminal bore including an internal thread through which the terminal screw is screwable to retain the electrical connection, the terminal screw including, a through-hole, and, a blind hole arranged concentrically with respect to the through-hole, the blind hole being embodied to receive a turning tool, the blind hole covering the through-hole and including a relatively greater cross-sectional area than the through-hole.

2. The connecting arrangement of claim 1, wherein the blind hole has a cross-section of a desired shape.

3. The connecting arrangement of claim 1, wherein the fixing screw is a countersunk head screw and the fixing opening includes a conically widened region for accommodating a head of the fixing screw.

4. The connecting arrangement of claim 3, wherein the countersunk head screw is a countersunk head screw including a hexagon socket, a countersunk head screw including a slot, a countersunk head screw including a cross-recessed head or a Torx countersunk head screw.

5. The connecting arrangement of claim 1, wherein the through-hole includes a circumferential first chamfer at the junction with the blind hole.

6. The connecting arrangement of claim 2, wherein the blind hole includes a circumferential second chamfer.

7. The connecting arrangement of claim 6, wherein on its external face, the terminal screw includes a circumferential third chamfer at one end or at both ends.

8. The connecting arrangement of claim 6, wherein the chamfers include an angle of between 30° and 60°.

9. The connecting arrangement of claim 1, wherein the blind hole extends over 50% to 90% of the length of the terminal screw.

10. An electrical switching device, comprising:

at least one connecting arrangement of claim 1, wherein the connecting arrangement is secured by way of the fixing screw in a releasable manner to at least one electrical contact of the electrical switching device.

11. The electrical switching device of claim 10, wherein the electrical switching device is a low-voltage circuit breaker.

12. The connecting arrangement of claim 1, wherein the connecting arrangement is for a low-voltage circuit breaker.

13. The connecting arrangement of claim 2, wherein the blind hole includes a square or equilaterally hexagonal cross-section.

14. The connecting arrangement of claim 5, wherein on its external face, the terminal screw includes a circumferential second chamfer at one end or at both ends.

15. The connecting arrangement of claim 8, wherein the chamfers include an angle of 45°.

16. The connecting arrangement of claim 7, wherein the chamfers include an angle of between 30° and 60°.

17. The connecting arrangement of claim 16, wherein the chamfers include an angle of 45°.

* * * * *